US006382597B1

(12) United States Patent
Mutschler

(10) Patent No.: US 6,382,597 B1
(45) Date of Patent: May 7, 2002

(54) METHOD AND DEVICE FOR PREVENTING AVALANCHES, SNOW SLIDES OR THE LIKE

(76) Inventor: Friedolf Mutschler, Schlosstrasse 2, D-88453 Erolzheim (DE)

( * ) Notice: Subject to any disclaimer, the term of this patent is extended or adjusted under 35 U.S.C. 154(b) by 0 days.

(21) Appl. No.: 09/445,039

(22) PCT Filed: May 29, 1998

(86) PCT No.: PCT/EP98/03233

§ 371 Date: Dec. 22, 1999

§ 102(e) Date: Dec. 22, 1999

(87) PCT Pub. No.: WO98/55698

PCT Pub. Date: Dec. 10, 1998

(30) Foreign Application Priority Data

Jun. 2, 1997 (DE) ..... 197 22 770

(51) Int. Cl.[7] ..... E01F 7/02
(52) U.S. Cl. ..... 256/12.5; 256/1
(58) Field of Search ..... 256/12.5, 13, 19, 256/23, 1, DIG. 2

(56) References Cited

U.S. PATENT DOCUMENTS 1,144,393 A * 6/1915 Swezey ..... 256/12.5
1,184,046 A * 5/1916 Swezey ..... 256/12.5
2,134,624 A * 10/1938 Royall ..... 256/1
3,473,786 A * 10/1969 Luebke ..... 256/12.5
4,000,618 A * 1/1977 Stovall ..... 61/1 F
4,335,868 A * 6/1982 Ribbert ..... 256/1
4,549,724 A * 10/1985 Tailandier ..... 256/12.5

FOREIGN PATENT DOCUMENTS

| | | |
|---|---|---|
| CH | 358459 | 1/1962 |
| CH | 674998 | 8/1990 |
| DE | 369074 | 12/1982 |

OTHER PUBLICATIONS

"Schneedruck Und Gleitschneeschutzbrucken", E. Leys, pp. 25–28, 1974.

* cited by examiner

*Primary Examiner*—Lynne H. Browne
*Assistant Examiner*—John B. Walsh
(74) *Attorney, Agent, or Firm*—Baker & Daniels

(57) ABSTRACT

A method and device for preventing avalanches and other snow slides. The snow mass is divided into individual layers or an existing division is used and the individual layers are mixed together. The dividing and mixing can take place horizontally and/or vertically and compacting can take place at the same time. The device consists essentially of a curved retaining bar (3) which is anchored to the slope and bears at least one lifting body (15). The lifting body is preferably arranged at a certain angle to the retaining bar.

12 Claims, 11 Drawing Sheets

1
9
3
6
8
2
5
4
7
3a
3b
3c
13

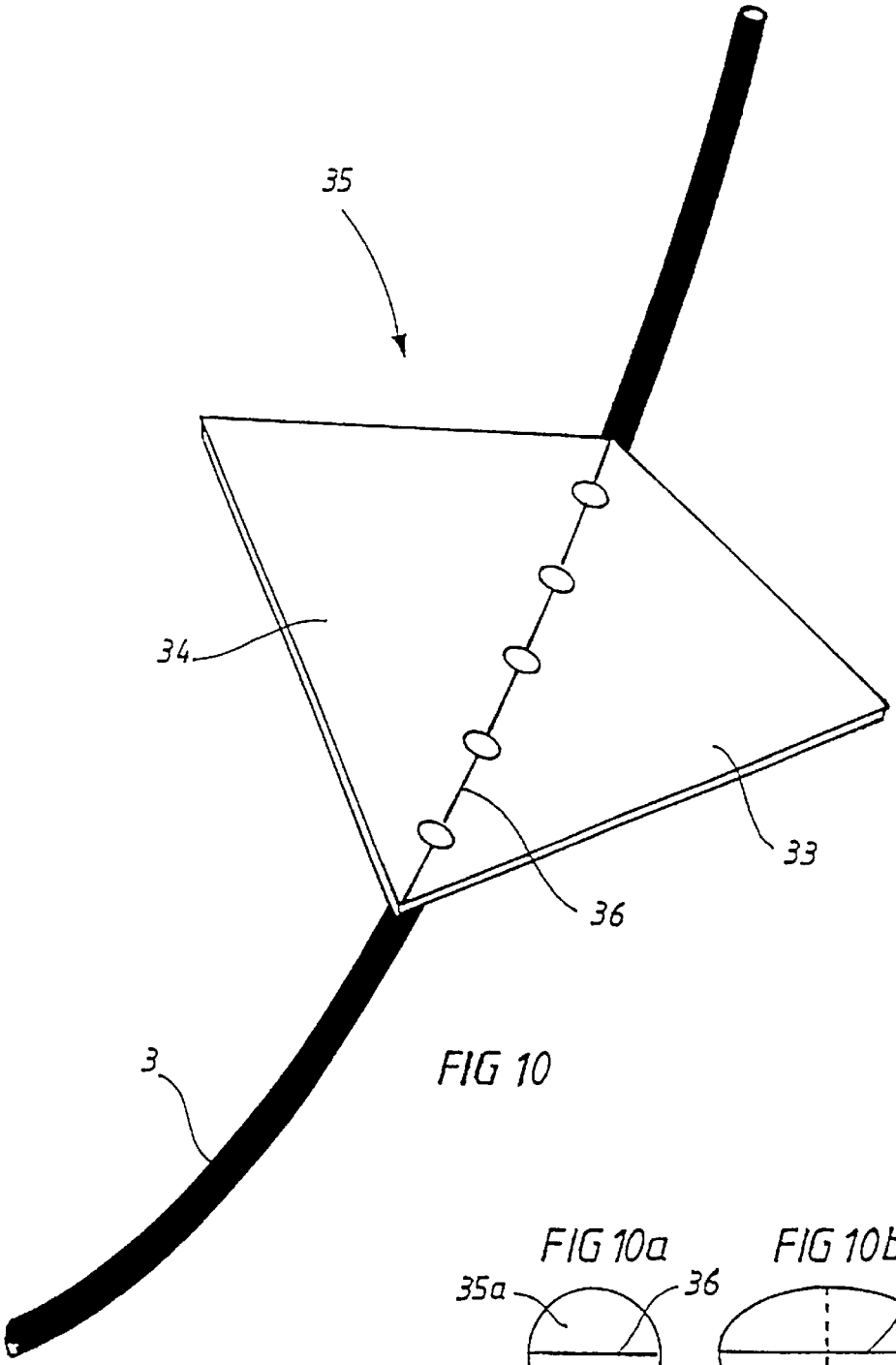
FIG 10
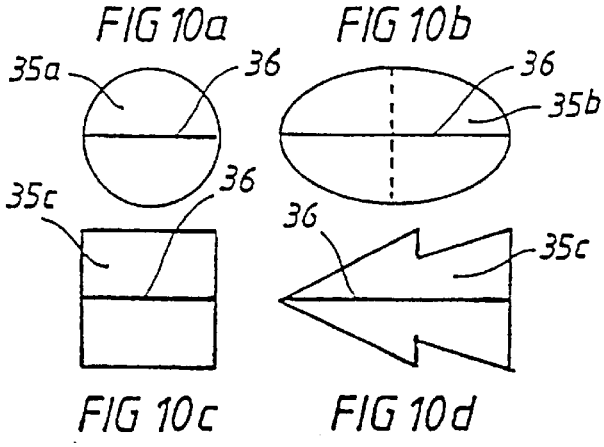

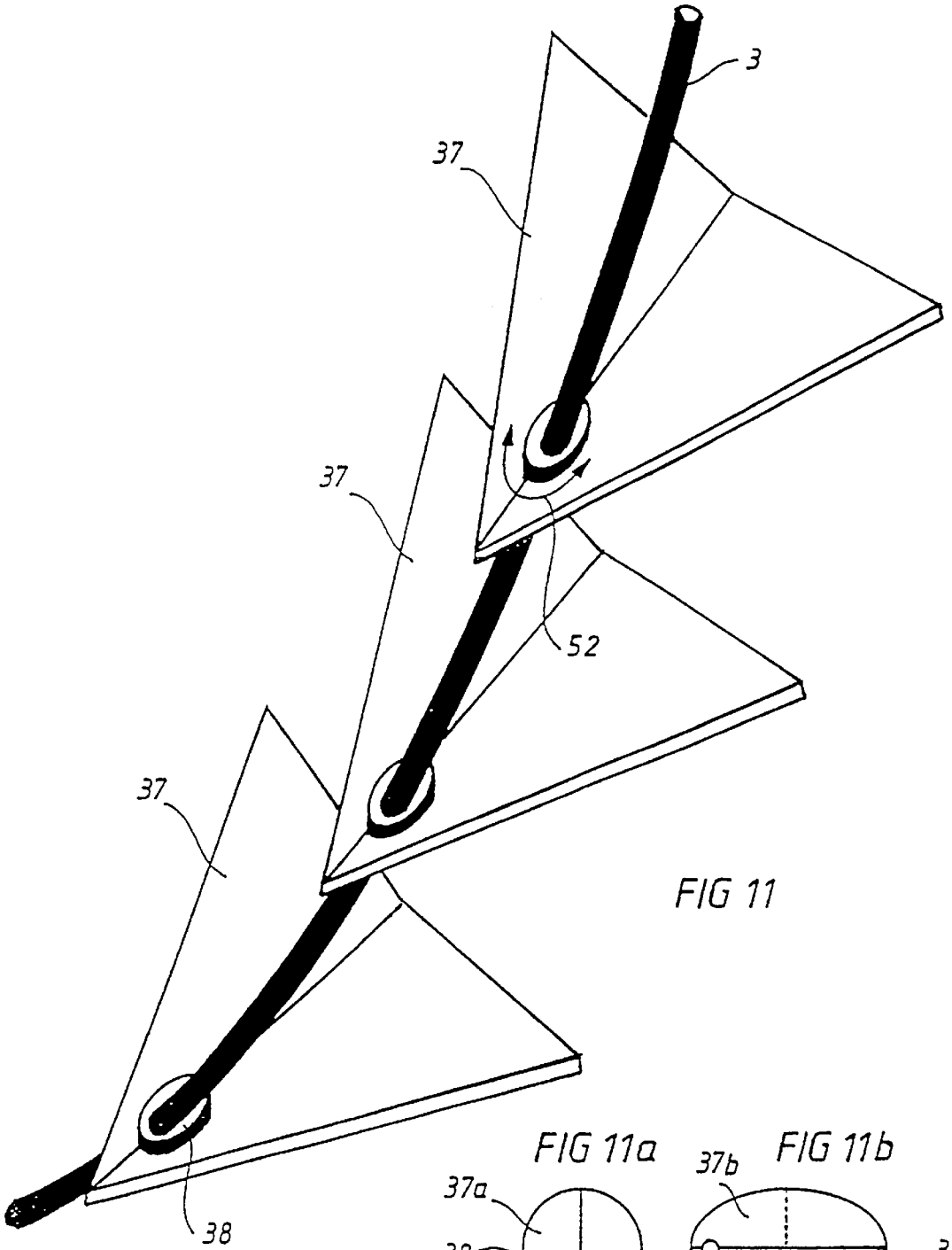
FIG 11
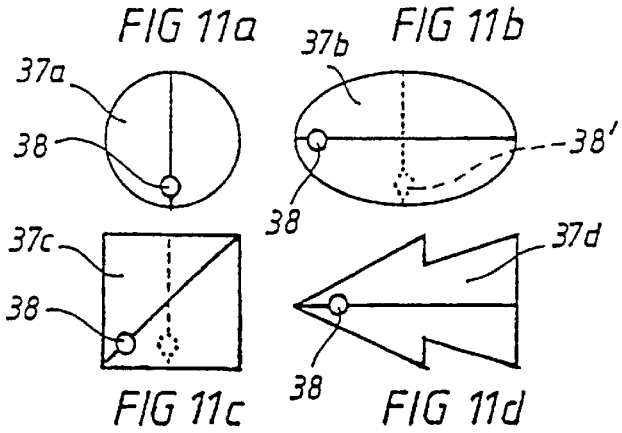

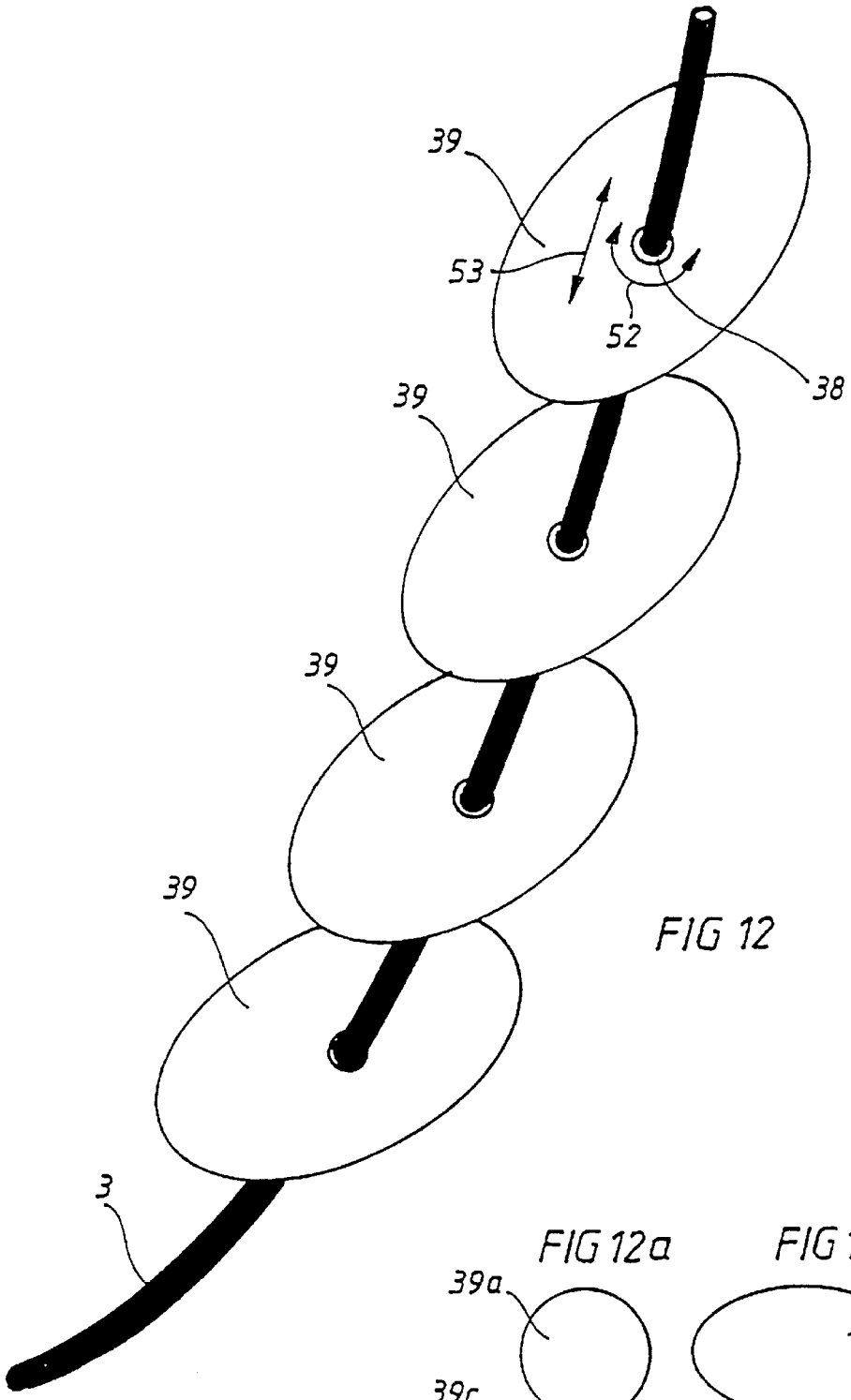
FIG 12
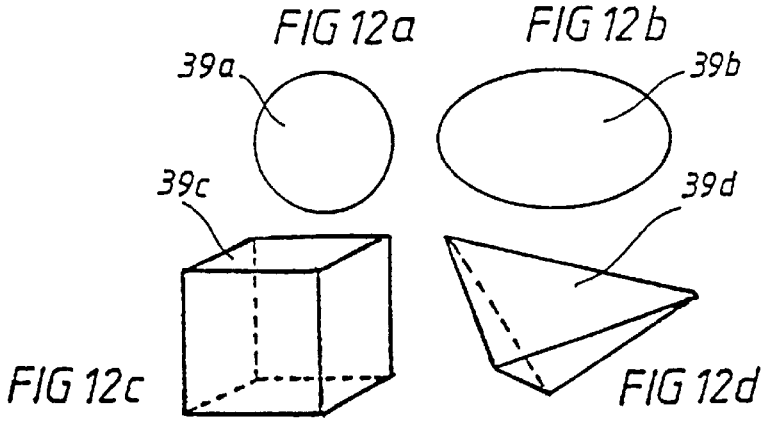

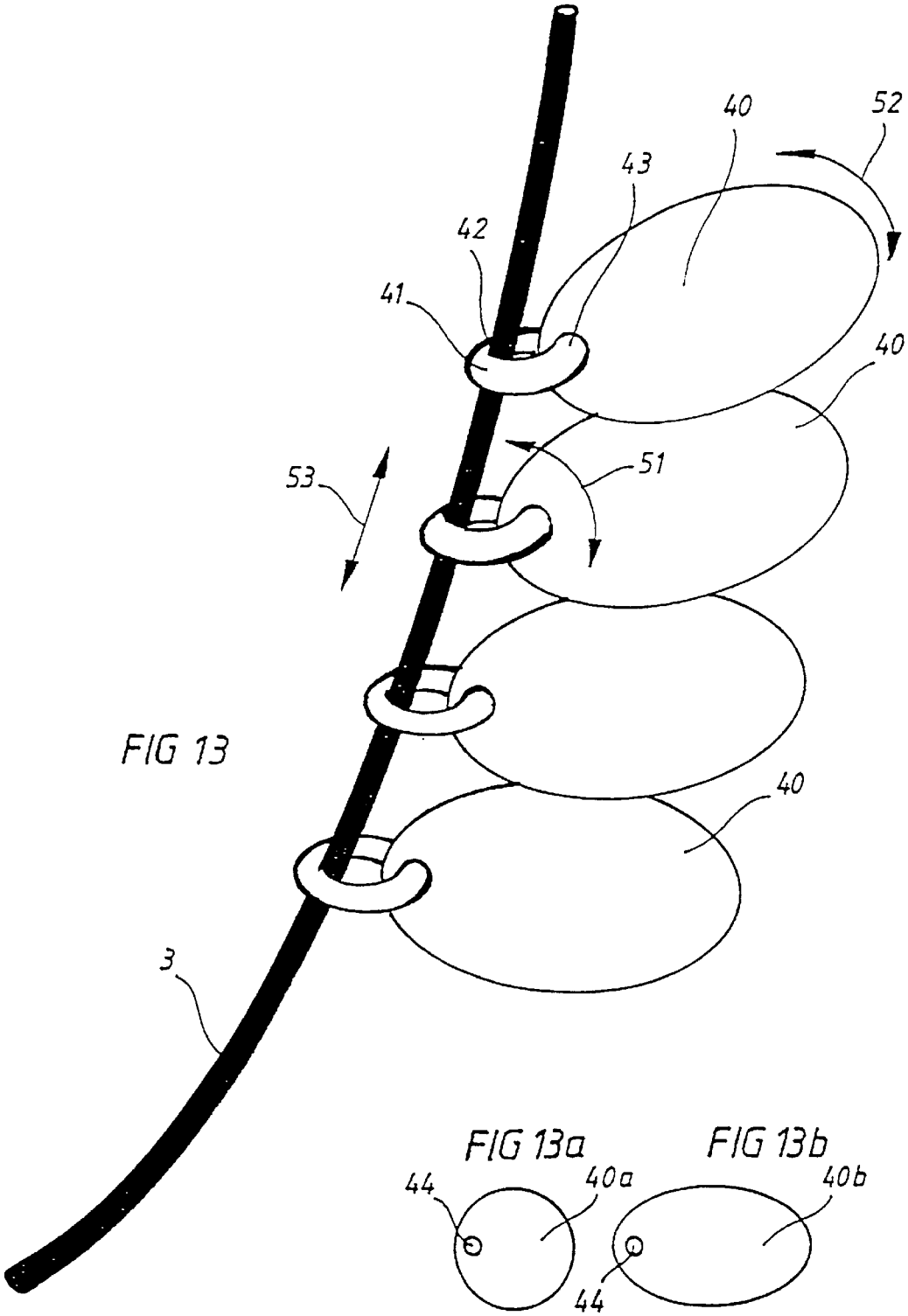
FIG 13
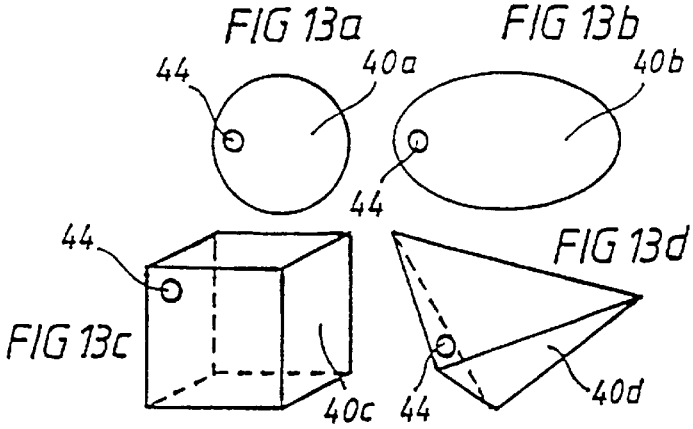

METHOD AND DEVICE FOR PREVENTING AVALANCHES, SNOW SLIDES OR THE LIKE

BACKGROUND OF THE INVENTION

1. Field of the Invention

The invention relates to a method and a device for preventing the development of avalanches and other snow slides.

2. Description of the Related Art

For simplicity, the invention will be described below only with reference to the prevention of avalanches although it is not limited thereto. Accordingly, the invention also relates to the prevention of other snow slides, such as preventing the development of windslabs, preventing loose snow avalanches, new snow slides, old snow slides, wet snow avalanches, ground avalanches, and any other form of known avalanches and other creeping and sliding snow movements.

Snow deposits on slope-like structures are not a stationary medium. It is a continuously downhill moving mass. Both natural causes and outside interference are able to change this moving process quite significantly. The force of an avalanche moving downhill can be described as an extreme variant of this change.

Before attempting to counteract the danger of such a force of nature the basic premise of a potential avalanche has to be defined, as follows:

Reduced adherence of a partial or global snow mass deposited on slopes and precipitous formations.

Reasons for reduced adherence:

a) extremely precipitous gradient;

b) air cushion effect resulting from cushion-like vegetation on the covered sections of the ground;

c) high degree of "creeping" and "sliding" in the affected snow mass;

d) different overlying layers of snow with varying physical properties;

e) above average snow accumulation as a result of precipitation or wind-related shifts;

f) structural weaknesses as a result of snow metamorphosis (change in the crystalline structure);

g) added mechanical stress due to outside interference (such as winter sports, game trails, sound waves).

Previously, the moving process of an avalanche was counteracted merely by a so-called passive correction of movement.

In accordance with prior art, such a correction of movement is achieved either by a solid obstruction transversely to the slope to prevent the snow mass from moving downhill or by specifically deflecting the global moving processes by means of solid obstacles. The latter is used primarily in areas close to a valley floor. On this subject, we are referring to EP 0 494 563, EP 0 346 326, DE 28 07 536 and EP 0 359 704, among others.

However, said known solid obstructions or said known specific deflections in areas close to a valley floor have the disadvantage of seriously intervening in the natural environment. Massive obstacles have to be built using expensive construction processes at high altitudes under difficult working conditions resulting in high production costs. The highest expense is the anchoring in the slope required for such obstructions because the downward driving force of the moving snow mass acting on the obstacles has to be channeled into the pertaining mounting devices approximately vertically to the slope. This requires extensive structural measures so as to control the forces acting on the obstacles like a tearing off force.

Patent CH 674 996 A shows an avalanche obstruction and a method to mount said obstruction where reinforcement elements are suspended from anchoring ropes. Said ropes are anchored in the mountain by means of anchoring devices interspaced from the reinforcement elements. The reinforcement elements substantially serve only to retain the snow and rest freely on the base, thereby intending to hold back the snow mass.

The drawback of this avalanche obstruction is that the reinforcement elements are designed axisymmetrical along a longitudinal center axis, for example as a pyramid, a cone or truncated cone, or as a cylinder, and consequently, the snow layers overflow the reinforcement element both on top and below causing the snow layers that flow over the top of the reinforcement element to be lifted up from the slope resulting in a certain detachment of the snow mass from the slope.

The result is that the snow mass detached from the slope and separated from the remaining snow begins to slide and thereby triggers avalanches comparatively easier than other snow masses, which are channeled toward the slope. Therefore, the snow layers above the reinforcement element are lifted above the reinforcement element when the snow begins to slide. They separate from the lower, slope-side snow layer and begin to slide very easily.

When new snow is added the new snow will build up on the surface of the upper snow mass and will also be channeled away from the slope together with the upper snow mass which was detached by the reinforcement element. This additionally increases the danger of triggering an avalanche.

Therefore, the disadvantages of the avalanche obstructions known in the art are the high production expenses, the high maintenance expenses and the serious intervention in the natural environment which is necessary to transfer the required forces to the existing ground and rock.

Accordingly, the object of the invention is to propose a method and a device for preventing the development of avalanches that prevent the formation of an avalanche as such at significantly lower production costs and whose production is significantly more cost-effective and requires a less serious intervention in the existing natural environment.

To solve the above problem the invention is characterized by the technical theory in accordance with the characteristic features of the method as per claim 1.

SUMMARY OF THE INVENTION

According to the invention, the snow mass moving downhill is separated into individual layers, not simply retained as is known in the art, or an existing division is utilized and the layers are mixed together. Said separation and mixing can take place in horizontal and/or in vertical direction. At the same time, the snow mass can be compacted.

Consequently, according to the technical theory of the invention, unstable snow structures are converted into stable compacted structures. Instead of stopping an uncontrolled moving process such a process is prevented from developing.

"Creeping" and "sliding" snow fields and the combination of these continuous moving processes provide the power potential required to modify the basic structure of the affected snow mass. The forces generated thereby not only transport, they also correct (transform) the existing directions of flow.

At the same time, the lack of adherence in the original layers is eliminated in that these layers are mixed together.

A respective device achieves the mechanical conversion (transformation) by means of a so-called snow transformer.

Wedge-shaped basic elements or variably designed geometric hollow bodies, hereinafter also referred to as separation elements or lifting elements, are mounted to elastic retaining rods that are anchored in the ground. This does not mean that the end of the rod is vertically planted into the ground. It is mounted parallel to the particular gradient of the slope. The retaining rod itself, however, is designed to straighten into a vertical position in rounded form after approximately ⅓ of its length.

The advantage of this particular mounting method is that the forces of the snow mass moving downhill slide over the actual fastening device in the ground, the retaining rod cannot break as a result of laterally acting forces. Vertical tensile forces, such as are known in mounting conventional avalanche obstructions, are thereby converted into a horizontal stress.

In order to fasten such a retaining rod flat to the ground (rock) it is sufficient to mount a simple "ground anchor" or "rock anchor". Any stress that may arise is deflected in rectangular form at its upper end, thereby providing maximum resistance.

The transformation itself, however, is provided by the separation elements mounted on the retaining rods. This has four very different effects:

1. Horizontal Compacting

A parallel sliding snow mass is forced to escape laterally. The affected snow mass compacts, thereby achieving a higher adherence potential, and comes to a standstill at the expected intervals as a result of a back-up.

2. Vertical Compacting

Functional process as per the horizontal deflection; however, the compacting process affects several layer levels.

3. Combination of Horizontal and Vertical Compacting

This represents the most extensive transformation in the affected snow mass.

4. Retaining Function

The respective separation elements not only modify the moving process of the snow mass sliding by, they also represent an obstacle counteracting the direction of flow.

In addition to is actual effect, the function of vertical compacting also ensures that the transformer functions optimally at varying snow levels because not only the flowing snow is deflected, the separation element itself also escapes the acting forces, thereby righting the entire snow transformer (retaining rod and separation element).

Of high importance are the varying setting angles at which the vertical separation elements are mounted to the retaining rods. The alpha angle between retaining rod and vertical separation element increasingly approaches a right angle toward the upper rod end, thereby counteracting an uncontrolled lifting motion when the snow level is low. Therefore, the transformer is unable to work itself out of the snow.

The method of arranging a snow transformer to secure an avalanche slope depends on the individual structures of the particular landscape. The direction of the selected compacting processes is related to the particularities of the respective ground profiles. It is also feasible to functionally couple adjacent transformers to form a lip-like new functional unit. Depending on each individual case, a fan-like or tree-like bundling of rods may also be used.

In comparing the production and installation costs of conventional avalanche obstructions with a transformer arrangement over an equivalent area the active transformation achieves an above-average cost reduction.

In addition to the functional and cost advantages the use of snow transformers also includes important additional functions which had to be accepted as apparently unsolvable deficiencies as a side effect accompanying the traditional avalanche safety structures:

1. Optimizing the optical environmental compatibility by means of transparent integration into the natural environment.
2. Minimal restrictions in the affected living space of the fauna.
3. Optimal intermediate security for recultivating open spaces that are subject to erosion.
4. Avalanche security even in places where this was previously achieved only with an above average financial burden because of loose ground structures, for example. Accordingly, the division of high forces into many small partial forces forms the basis for economical overall logistics.

The subject of the invention is not only the result of the subject of the individual patent claims, it is also a result of combining the individual patent claims.

All information and characteristic features disclosed in the documents, including the abstract, particularly the spatial design shown in the drawings, are claimed as relevant to the invention insofar as they are new compared to the prior art, either individually or in combination.

The invention is explained in more detail below by means of the drawings that illustrate several exemplary embodiments. The drawings and the respective explanations contain further characteristic features and advantages that are relevant to the invention.

BRIEF DESCRIPTION OF THE DRAWINGS

The drawings show the following:

FIG. 10: A further embodiment of a lifting element;

FIGS. 10*a*–10*d:* Additional exemplary embodiments of the lifting elements;

FIG. 11: An exploded view of a further embodiment of the lifting elements;

FIGS. 11*a*–11*d:* Additional exemplary embodiments of the lifting elements as per FIG. 11;

FIG. 12: A further embodiment of a lifting element;

FIGS. 12*a*–12*d:* An illustration of additional potential lifting elements compared to FIG. 12;

FIG. 13: A further embodiment of a lifting element;

FIGS. 13*a,* 13*b:* Additional potential embodiments of lifting elements as per FIG. 13;

FIGS. 13*c,* 13*d:* Additional potential embodiments of lifting elements as per FIG. 13;

DETAILED DESCRIPTION OF THE INVENTION

Figures 1, 1A, 1B, 1C:
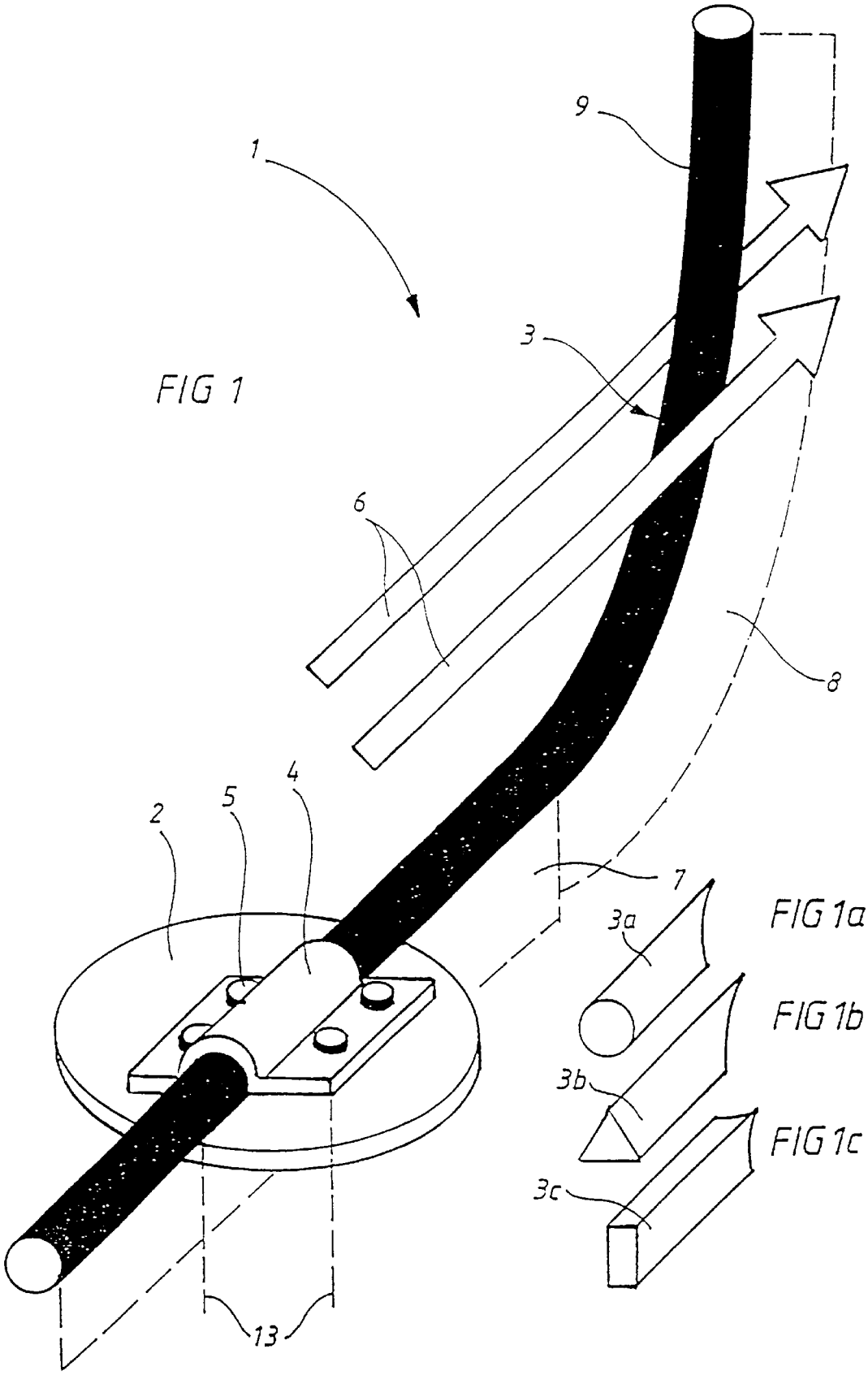
FIG. 1: Diagrammatic exploded side view of a retaining device (not including lifting element)
FIGS. 1*a*–1*c:* Various potential profiles for a retaining rod as per FIG. 1.

According to a preferred embodiment, the avalanche obstructing structure of the invention comprises a retaining device 1, which in turn comprises a mounting plate 2 anchored in the slope on which plate a retaining rod 3 is mounted by means of a mounting device 4. The retaining rod is designed as a round-profiled, elastic rod, consisting, for example, of a plastic material, steel, wood, aluminum alloys, glass fiber, carbon plastic materials, etc. It is important that the retaining rod 3 has a bottom part 7 which is oriented approx. parallel to the slope's gradient which part of the retaining rod 3 is seated in the mounting device 4 of the mounting plate 2, while the top part 8 joining the bottom part 7 slants away from the slope at the top and may slant diagonally downhill, for example.

The direction of flow 6 of the snow mass is oriented such that if a tensile force acts on the retaining rod 3 said tensile force is channeled preferably in axial direction to the mounting device 4 via the bottom part 7 so as to generate a high retaining force.

Channeling a tensile force acting on the retaining rod 3 in the direction of the arrow 6 is advantageous because it safely prevents the retaining rod 3 from shearing off in the mounting device 4. This represents a significant advantage compared to the conventional avalanche obstructing structures which are typically approx. vertical or slanted at an angle with respect to the slope and where it is very difficult to transfer the force acting on the avalanche obstructing structure to the bedding in the ground.

According to the invention, the transfer to the bedding is achieved via a mounting plate 2 anchored in the slope by means of anchors 13 which are not shown in more detail.

The anchors 13 may assume the function of securing the retaining rods 3 at the same time, but it is also feasible to provide several screws 5 to secure the mounting device 4 on the mounting plate 2.

Furthermore, FIGS. 1*a*–1*c* illustrate that retaining rods 3*a,* 3*b,* 3*c* with a different profile may be used instead of the round profile of retaining rod 3. FIG. 1*a* shows an elliptical profile, FIG. 1*b,* a triangled profile, and FIG. 1*c* a square or rectangular profile.

It is important for all profile types to ensure an adequate transfer of force to the bedding when a respective force acts on the retaining rod 3, 3*a*–3*c* in the direction of the arrow 6.

Furthermore, according to the invention the head 9 of the retaining rod 3 is not required to stick out of the snow. It may be completely covered by snow.

Figure 2:
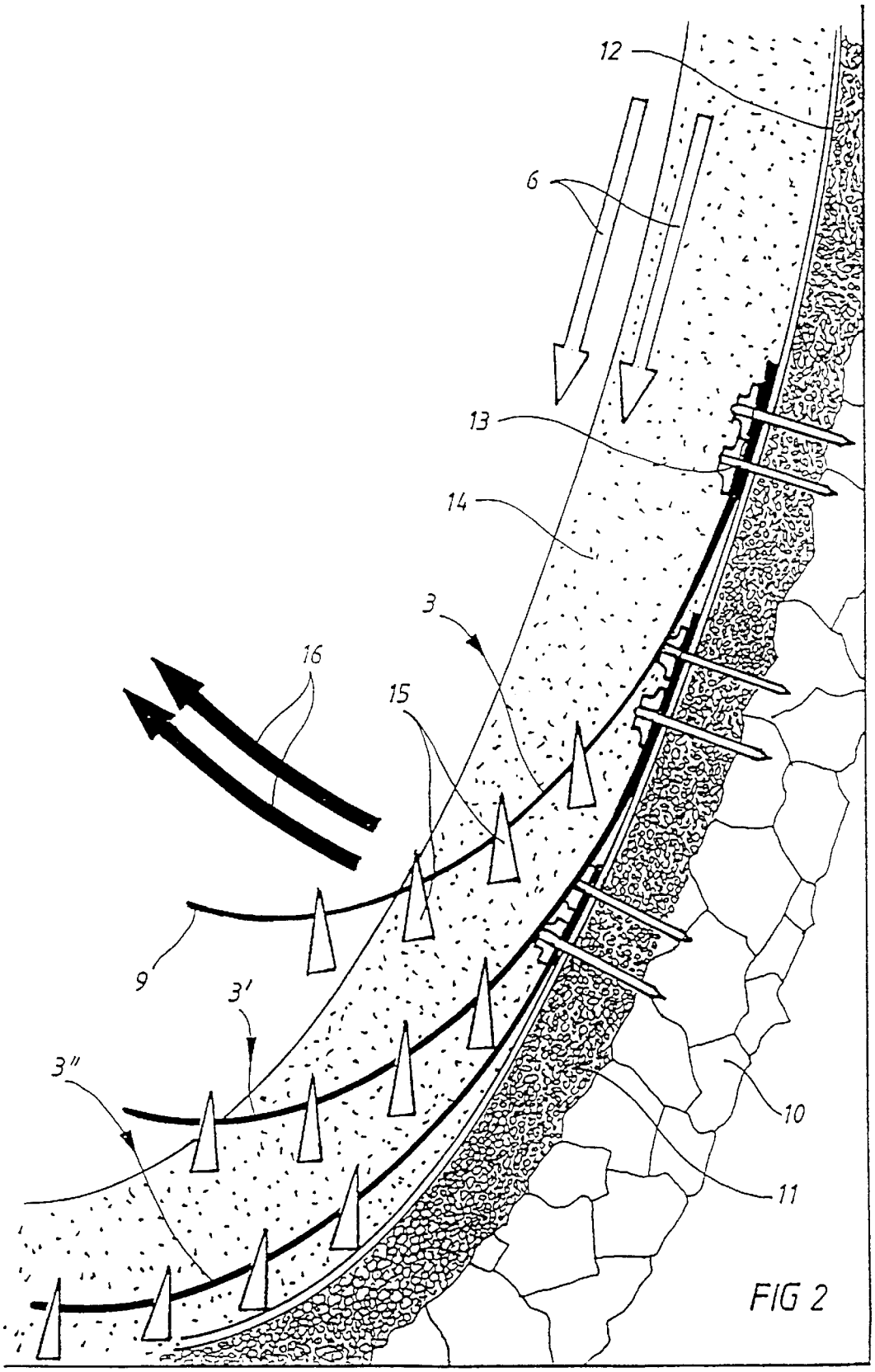
FIG. 2 Diagrammatic section of a slope with the structure of the invention.

FIG. 2 shows a diagrammatic view of a slope section where the development of an avalanche is to be prevented in a snow layer 14 oriented downhill.

Shown diagrammatically, the slope consists of rock 10 covered by a layer of rubble 11, which in turn is covered by a thin humus layer 12.

The anchors 13 associated with the mounting plate 2 preferably extend into the rock 10.

Tests conducted by the applicant, however, have shown that the anchors do not necessarily have to extend down into the rock 10. It suffices to anchor said anchors in the rubble 11 because of the favorable transfer of force and because of the particular technical theory.

It is important that the tensile force on the retaining rods does not have a component which is directed away from the mounting surface toward the snow layer as is the case in conventional avalanche obstructions. Instead, the retaining force is transferred directly from the mounting plate 2 to the slope via the anchors 13 which are arranged approx. vertical thereto.

Of course, it is not required for the invention that the longitudinal axis of the anchors 13 is vertical with respect to the mounting plate 2. The anchors may also be driven diagonally downward (downhill) into the rubble layer or into the rock layer.

Furthermore, the anchors 13 are not required to have a nail-like design. They may be equipped with respective screw surfaces, they may be designed like tent anchors, as profiled rods, etc.

The shaping of such anchors (also called rock anchors or rock pins) is not the subject of the invention.

The avalanche obstruction of the invention now comprises the retaining devices 1 described above by means of FIGS. 1–1*c,* and it is important to arrange respective lifting elements 15 on the retaining rods 3. Said elements are arranged interspaced on the retaining rods 3, 3', 3" and firmly or rotating, preferably non-shifting, however.

The lifting elements 15 shown here are arrow-shaped elements whose pointy side engages uphill in the snow layer and whose broader side points downhill.

The design as per FIG. 2 results in the significant advantage that the snow layer 14 sliding downhill meets the lifting elements 15 which are lifted in the direction of the arrow 16 because of the direction of flow 6, thereby elastically carrying along the retaining rods in the direction of the arrow 16.

This process separates the snow layer 14 in both horizontal and vertical direction, thereby producing various compacting and relieving zones in the snow layer 14 as explained in more detail below by means of FIGS. 3–5.

Figure 3:
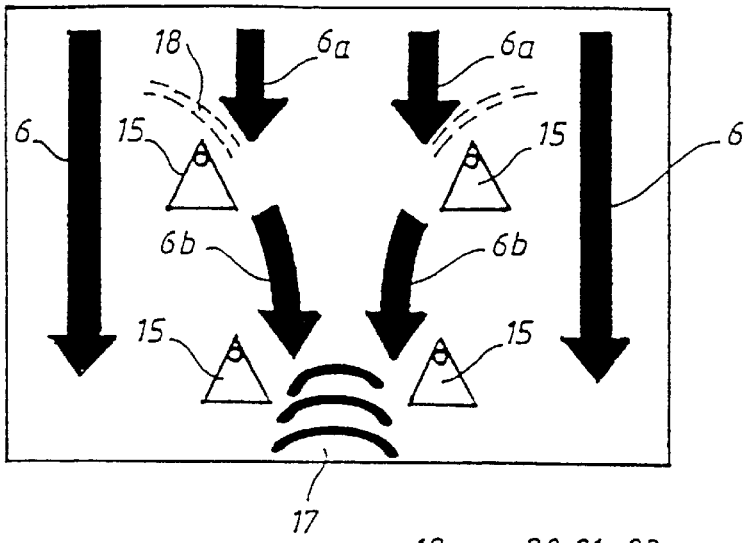
FIG. 3 The relationship of forces when the snow mass flows around the lifting element.

FIG. 3 shows that initially the snow layers are also able to laterally bypass the avalanche obstruction of the invention unimpeded in the direction of flow 6 because the avalanche obstructing structure cannot cover the entire width of the snow covered slope.

Insofar as the snow layer 14 meets the lifting elements 15, however, back-up zones are developing at position 18 in front of the lifting elements 15, and the snow layers are deflected in the direction of the arrows 6*a,* 6*b,* bypassing the lifting elements 15, thereby developing compacting zones 17 in addition to the back-up zones 18.

Figure 4:
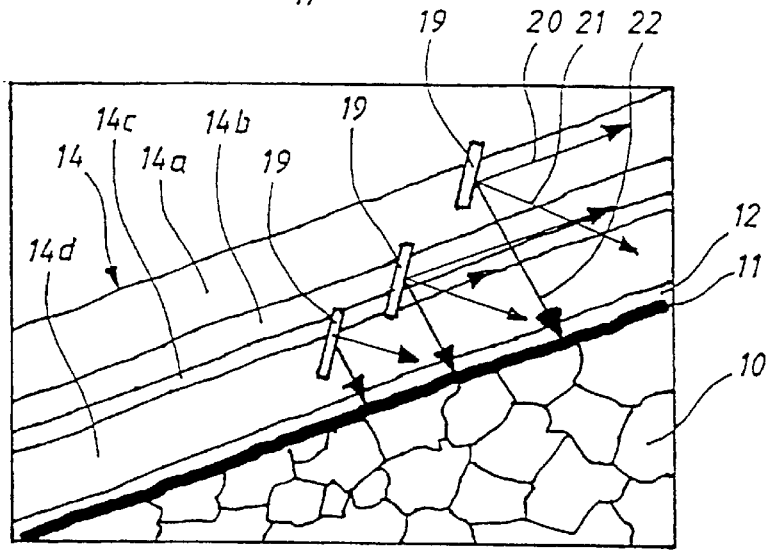
FIG. 4 A section of a slope illustrating the relationship of forces acting on the vertically overlaying snow layers.

Consequently, the snow layer 14, which typically comprises several vertical overlaying snow layers 14*a*–14*d,* is separated into various layers by means of the lifting elements shown and by means of the deflection surfaces 19 on the lifting elements, as shown in FIG. 4.

An illustration of the vectors shows that the forces directed downhill are divided into an uphill vector 20, approx. parallel to the plane of the slope, a vector 22 directed vertical to the plane of the slope and a vector 21 produced thereby, which is approx. diagonal to the plane of the slope.

Figure 5:
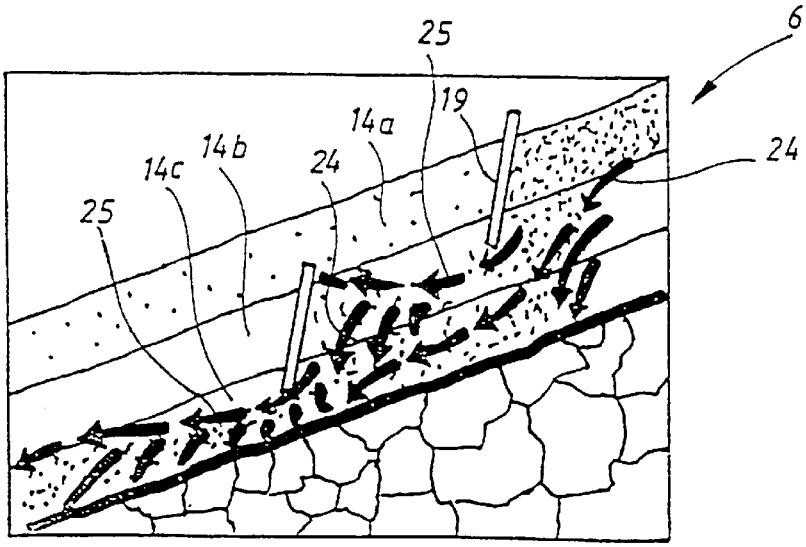
FIG. 5 Diagram of movement of the snow mass flowing downhill.

According to FIG. 5, this results in an arbitrary and intended mixing of the individual vertically overlaying snow layers 14*a*–14*d*. The snow mass meeting the top deflection surface 19 in the direction of the arrow 6 in flowing direction is deflected in the direction of the arrow 24 so that the top snow layer 14*a* flows into and combines with the middle snow layer 14*b* and, in the form of a combined current, meets the downstream oriented further deflection surface 19 again where the middle snow layer meets the bottom snow layer, is deflected in the direction of the arrow 24, combines with the bottom snow layer 14*c* and continues in the direction of the arrow 25.

Vertically mixing the snow layers as shown here causes the snow layer 14 to solidify overall because the snow layers 14*a*, 14*b*, 14*c*, which would normally tear off and possibly separate, interlace and combine.

Therefore, the development of an avalanche is prevented from the very beginning because the snow mass, which would otherwise continue to slide slowly, is interlaced as a result of the method of the invention, thereby preventing an individual snow mass from tearing off, whether horizontally or vertically.

It should be specifically noted that the invention does not intend to slow down an avalanche already sliding at high speed. The invention prevents the development of such avalanches from the very beginning.

Of course, the invention is not limited to achieving a vertical mixing of overlaying snow layers, but is also achieved similarly in horizontally adjacent snow layers because the deflection surfaces shown here not only cause mixing in vertical direction, they also act in horizontal direction (adjacent) so as to interlace and interlink adjacent, approx. rope-like snow masses.

The following exemplary embodiments show various lifting elements which all have the same purpose, i.e. they do not represent a rigid structure. Instead, they are mounted to elastic retaining rods and, essentially in the manner of kites or dovetails, deflect the snow within a slowly sliding snow layer such that it combines and interlaces.

It is important for all exemplary embodiments that the forces acting on the lifting elements are advantageously transferred in axial direction to the associated retaining rod 3, and that said rod optimally transfers the tensile force acting on the rod to the slope without shearing off or highly stressing the bedding.

Figure 6:
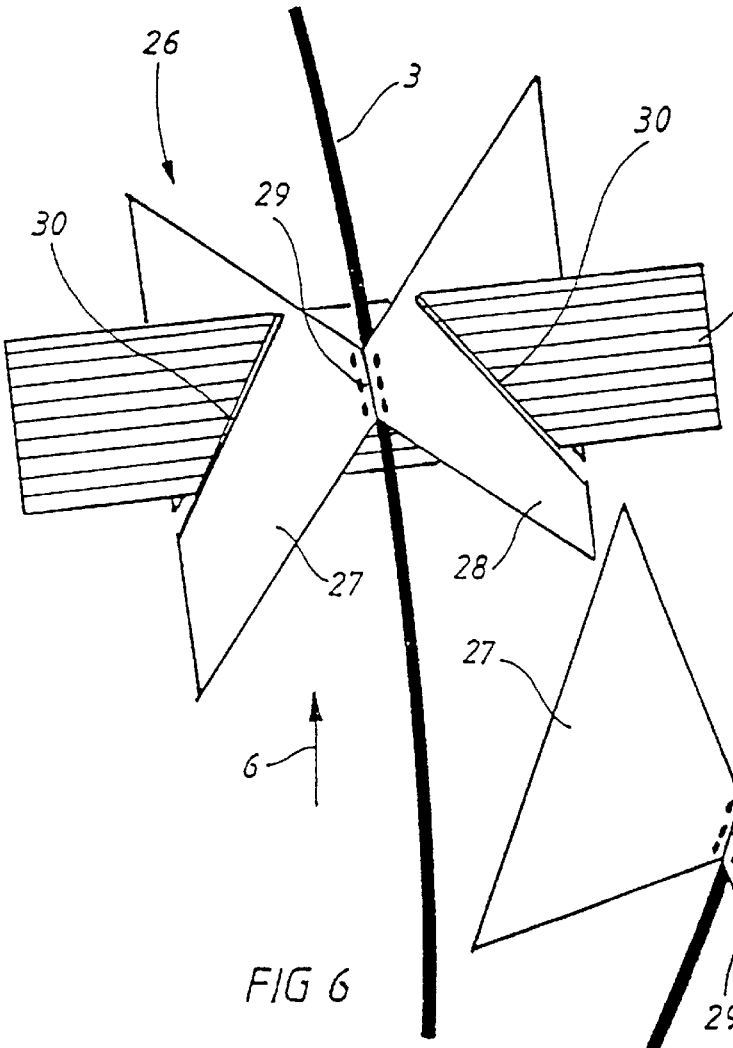
FIG. 6 A further embodiment of a lifting element.
Figure 8:
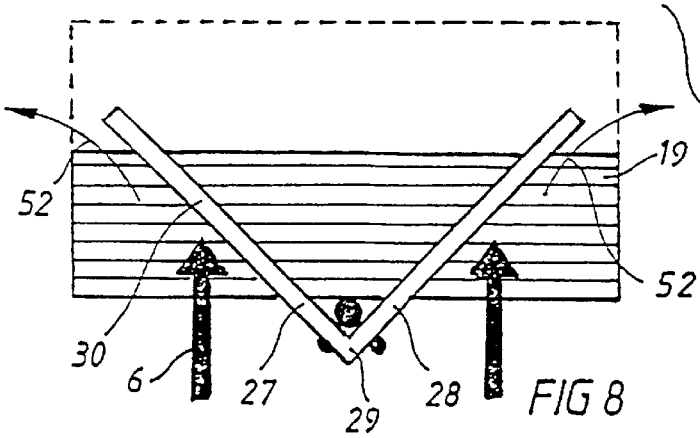
FIG. 8: Top view of the lifting element as per FIG. 6.
Figure 9:
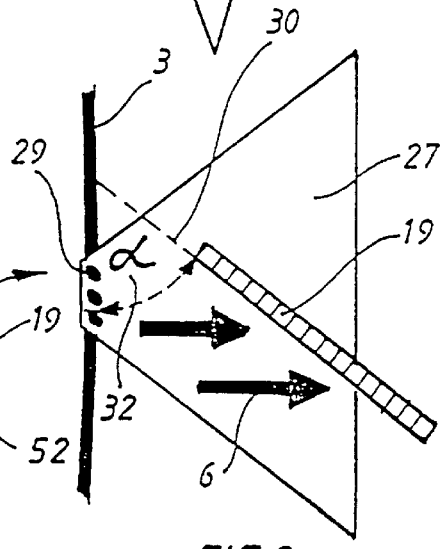
FIG. 9: Side view of the lifting element as per FIGS. 6 and 8.

The structure of a lifting element 26 shown in FIGS. 6, 8 and 9 substantially comprises a steel plate folded in the center and mounted to the front of the retaining rod 3 in the manner of a snow plow with an arrow-shaped front 29. This snow plow-shaped structure is equipped with two deflection blades 27, 28 which are arranged at an angle, symmetrical to the longitudinal center axis and firmly connected.

In the area of the two deflection blades 27, a slit 30 through both blades 27, 28 is provided where a plate-shaped deflection sheet 19 is inserted and anchored. The deflection sheet 19 is designed slanted at an angle 32 to the longitudinal axis of the retaining rod 3 such that the snow mass acting approx. parallel to the slope and flowing in the direction of the arrow 6 is deflected diagonally to the slope.

The alpha angle (angle 32) is variable and adjustable to the respective requirements. Also, the deflection sheets 19 arranged on the retaining rod 3, for example, may be arranged at a different angle 32 with respect to the respective retaining rod than the deflection sheets 19 arranged on the retaining rods 3', 3", for example. The result is that the snow layers 14 are mixed differently.

Furthermore, FIG. 2 is also intended to show that the obstructing structures anchored in the slope are interspaced and offset from each other, or they may also be aligned in a downhill oriented arrangement.

When the snow mass flowing in the direction of flow 6 acts on the deflection blades 27, 28, said snow mass is separated and deflected by the deflection blades 27, 28 in the direction of the arrow 52 while at the same time meeting the deflection sheet 19 in the direction of flow 6 where the vertically overlaying snow layers 14*a*–14*d* are mixed, as illustrated by FIGS. 4 and 5.

Figure 7:
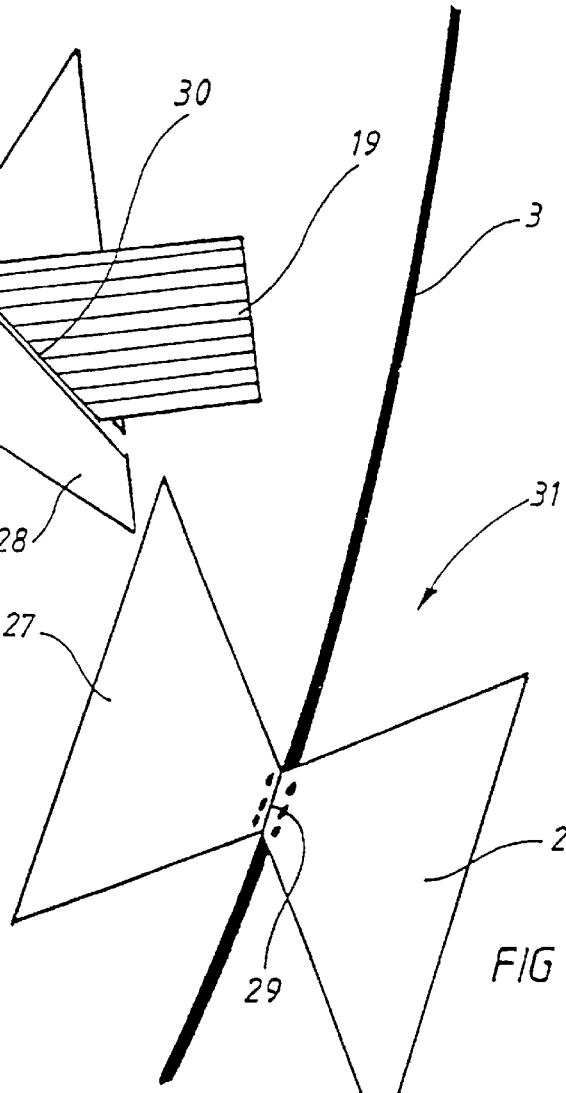
FIG. 7: A third embodiment of a lifting element.

FIG. 7 shows a further exemplary embodiment of a lifting element 31 having the same snow plow-shaped deflection blades 27, 28 as explained by means of FIGS. 6–9, but not including the diagonally downhill oriented deflection sheet 19.

The lifting element 35 shown in FIG. 10 again has two blades 33, 34 which are positioned on a level in the exemplary embodiment shown. However, the embodiment is not restricted thus. The blades may also be bent along the mounting line 36 on the retaining rod 3. A lifting element 35 of this type is designed similar to a kite, and like a kite, it is designed to generate a respective lifting force in a downhill sliding snow mass so as to cause the adjacent and overlaying snow layers to mix and interlace.

Furthermore, FIGS. 10*a*–10*d* show that not only a rhombic structure is feasible as per FIG. 10, but a plate, an ellipse, a rectangle or a square or an arrow-shaped structure may also be used for the lifting elements 35*a*–35*c*.

In the exemplary embodiment shown, the lifting elements 35–35*c* are connected to the retaining rods firmly and non-rotating. However, they may also be designed to rotate along the mounting line, which rotation is restricted by means of corresponding stopping devices.

FIG. 11 illustrates that it is possible for the lifting elements 37 to rotate around the retaining rod 3 in the direction of the arrow 52. The triangular shaped lifting elements 37 are mounted to the retaining rod 3 by means of respective mounting devices 38. Longitudinal shifting along the retaining rod 3 should be avoided, but a rotation in the directions of the arrow 52 is possible.

Again, FIGS. 11*a*–11*d* illustrate that instead of designing the lifting elements 37 arrow-shaped, the lifting elements 37*a*–37*d* may also be designed as a disk, ellipse, square or rectangle or have an arrow-shaped structure.

Also, it is not required for the invention that the mounting boring 38 is located in the longitudinal axis of symmetry of the lifting element. It may also be provided in the transverse axis of symmetry as is the mounting boring 38'.

FIG. 12 illustrates that the lifting elements 39 may also be designed as hollow bodies or solid bodies where the lifting elements 39 have an approximately egg-shaped structure, and the mounting boring 38 again may be designed such that the lifting elements 39 are arranged on the retaining rod 3 either rotating or non-rotating, but always non-shifting.

Of course, the term "non-shifting" on the retaining rod also means that the lifting elements may be allowed a certain range of motion in the retaining rod's longitudinal direction. Said range of motion should be restricted by means of respective stopping devices on the retaining rod. Said range of motion is suggested by the directions of the arrow 53 in FIG. 12. Also, as explained above, a rotation around the mounting boring 38 in the directions of the arrow 52 is feasible.

FIGS. 12*a*–12*d* illustrate again that instead of the egg-shaped lifting elements 39, other structures may be used, such as a sphere, an egg, a cube or a polygonal arrow-shaped body.

Of course, on the above structures it is possible to mount respectively associated deflection sheets whose function is to ensure that the lifting element around which the snow mass flows in the direction of the arrow 6 will indeed carry out its intended function as per FIGS. 4 and 5.

FIG. 13 shows a lifting element as described by means of FIGS. 12–12*d* except for using a different mounting method. The lifting elements 40, 40*a*, 40*d* shown therein each have a mounting boring 43 through which a ring 41 engages, which ring encompasses the retaining rod 3 by means of a mounting device 42.

According to this design, the ring 41 in the mounting device 42 may be connected with the retaining rod 3 non-rotating and non-shifting.

According to a further embodiment, however, the ring 41 may be arranged on the retaining rod 3 so as to shift in the directions of the arrow 53 (by a restricted shifting distance).

It is also possible to design the mounting device 42 rotating on the retaining rod so as to allow the ring 41 to rotate around the retaining rod 3 (direction 51).

Similarly, the ring 41 may be connected non-rotating with the lifting element 40 in the area of the mounting boring 43.

However, it is also feasible for the mounting boring 43 to provide the ring 41 reaching through said boring with a range of motion, so that the lifting element 40 swivels around the ring 41 in the directions of the arrow 52.

Again, FIGS. 13*a*–13*d* show that varying lifting elements may be attached to the ring 41 by means of their boring 44.

Figure 14:
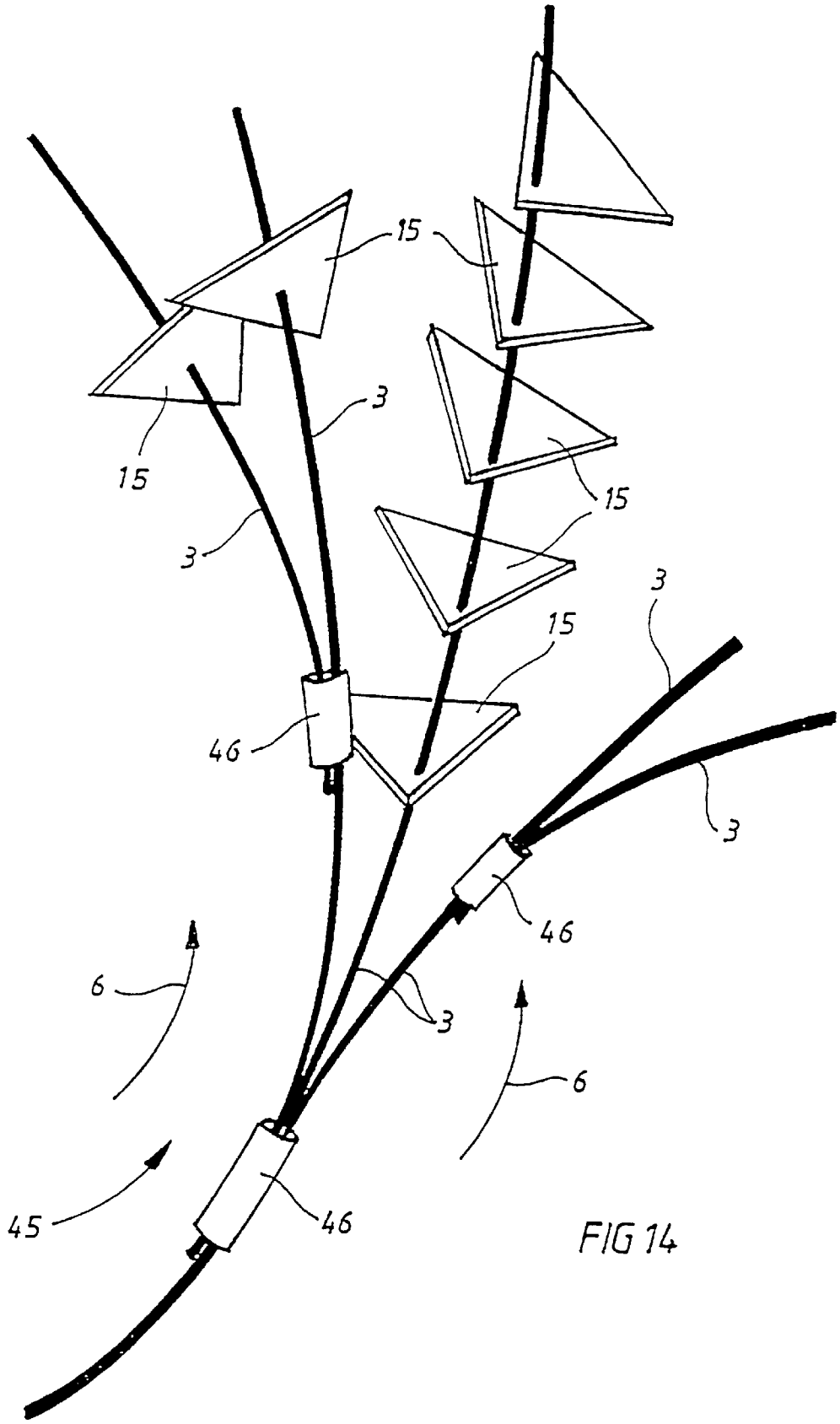
FIG. 14: A modified embodiment of an avalanche obstruction structure.
Figure 15:
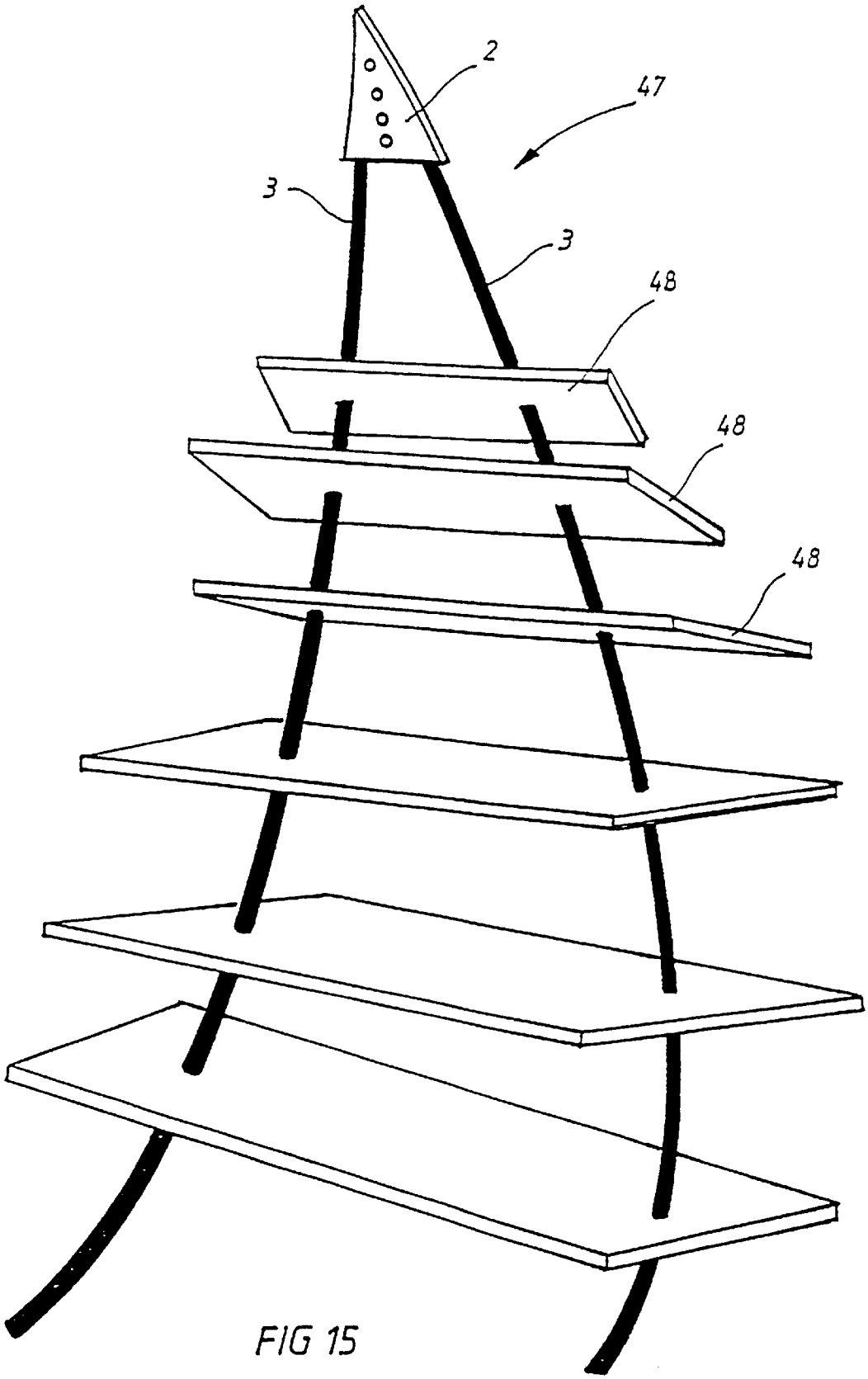
FIG. 15: A revised embodiment of FIG. 14.

FIGS. 14 and 15 show various examples of retaining rod 3 combinations which are connected in a net-like or fan-like structure. The lifting elements shown therein, however, are replaceable by the lifting elements shown in all preceding figures. Accordingly, FIGS. 14 and 15 are not limited to the lifting elements shown therein.

For FIG. 14, it is important that several retaining rods 3 are connected in the area of a respective collar 46 and spread out approximately fan-like with each retaining rod 3 carrying its associated lifting elements 15. The collars 46 are retaining the retaining rods, which are branching out like the branches of a tree, in a joint collar 46 which, in turn, is mounted to a retaining device 45 (not shown in detail).

Using this method, tree-shaped structures are proposed for avalanche obstructions and it is evident that the snow mass flowing downhill in the direction of flow 6 is separated and mixed and interlaced by means of the lifting elements 15 of the invention, both in horizontal and in vertical direction.

FIG. 15 shows a further embodiment of the tree structure for the retaining rods 3. It is evident that several retaining rods 3 are connected by means of pertaining lifting elements 48 which are coupled together in a joint holding device 47.

Again, the invention is not limited to two retaining rods 3 forming such a structure. Several retaining rods may be provided which are connected by means of connecting lifting elements 48.

Figure 16:
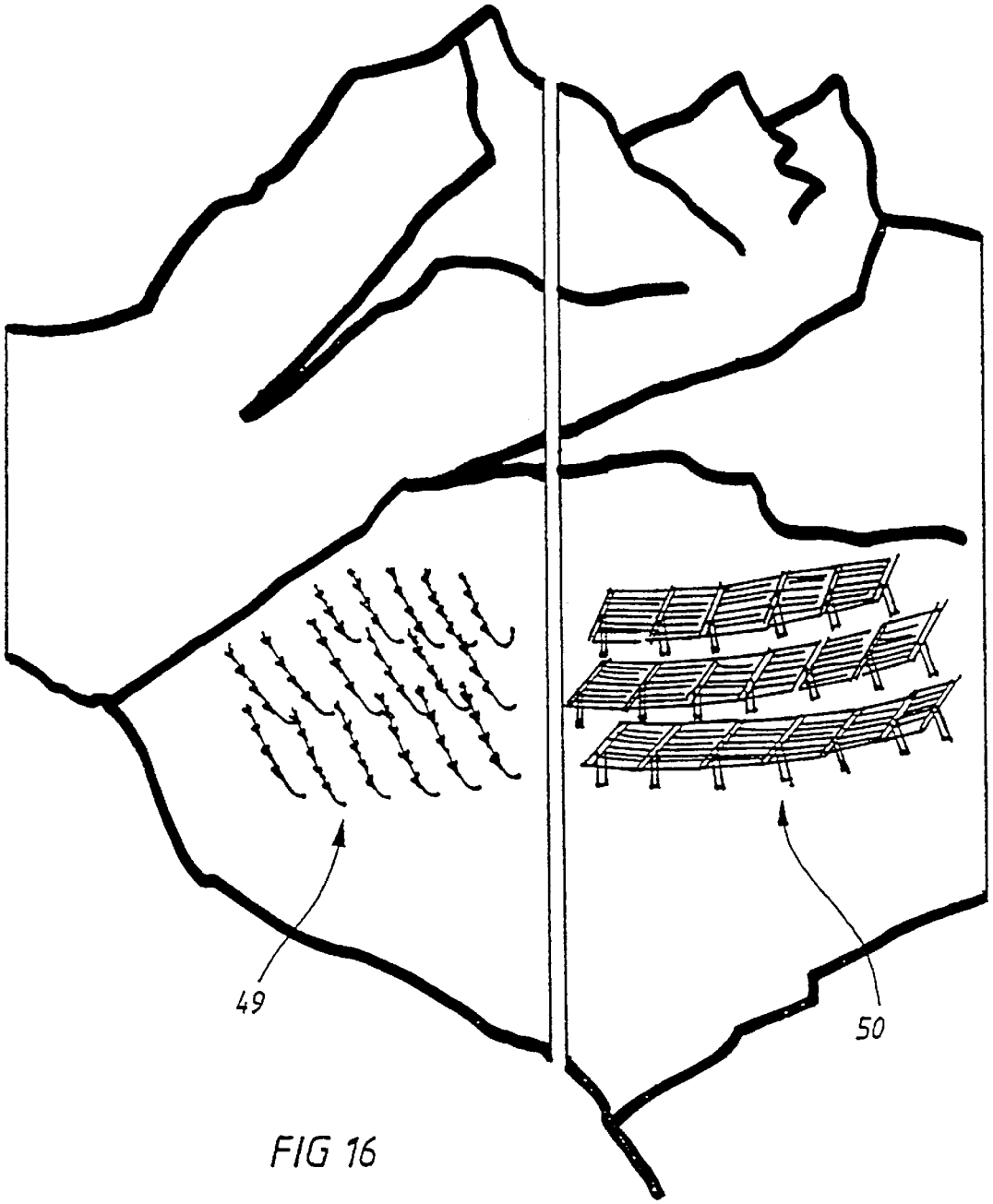
FIG. 16: Comparison of an avalanche obstructing structure as per the invention compared to prior art.

FIG. 16 shows a comparison of the obstructing structure 49 of the invention with an obstructing structure 50 according to prior art.

FIG. 16 demonstrates that the obstructing structure 49 of the invention produces a fragile, transparent structure on a protected slope. The advantages provided by said structure are already itemized in the general specifications under Nos. 1–4.

Accordingly, a massive intervention in the natural environment is prevented by anchoring relatively elastic and thin rods in the ground, which are virtually invisible from a distance, and which are furthermore preferably covered by snow layers in winter.

DRAWING REFERENCE LIST

1. Holding device
2. Mounting plate
3. 3', 3" retaining rods 3*a, b, c*
4. Mounting device
5. Screws
6. Direction of flow
7. Bottom part
8. Top part
9. Head
10. Rock
11. Rubble
12. Humus layer
13. Anchor
14. Snow layer *a*–*d*
15. Lifting element
16. Direction of arrow
17. Compacting zone
18. Back-up zone
19. Deflection sheet
20. Vector
21. Vector
22. Vector
23.
24. Direction of arrow
25. Direction of arrow
26. Lifting element
27. Deflection blade
28. Deflection blade
29. Arrow-shaped front
30. Slit
31. Lifting element
32. Angle
33. Blade
34. Blade
35. Lifting elements *a*–*c*
36. Mounting line
37. Lifting elements 37*a*–37*d*
38. Mounting boring 38'
39. Lifting element
40. Lifting element
41. Ring
42. Mounting device
43. Mounting boring
44. Boring
45. Retaining device
46. Collar
47. Retaining device
48. Lifting element
49. Obstructing structure
50. Obstructing structure (prior art)
51. Direction of arrow
52. Direction of arrow
53. Directions of arrow

What is claimed is:

1. A method for preventing the development of ground supported avalanches and other snow slide phenomena on a slope surface, characterized in that a ground supported snow mass is separated into individual snow layers and deflected in general in the direction of the slope surface by means of lifting elements whereby the separated and deflected individual layers are mixed together such that neighboring snow mass layers are fed one under the other.

2. The method of claim 1, wherein the separation and the mixing processes take place in both horizontal and vertical directions.

3. The method of claim 2, wherein said individual snow layers are additionally compacted.

4. A device for preventing the development of avalanches and other snow slide phenomena, said device comprising a curved, elastic retaining rod having a free end and being anchored in a slope at its opposite end, said rod having a generally downslope orientation, said retaining rod carrying at least one lifting element positioned downslope of the end where said rod is anchored in the slope, wherein said at least one lifting element comprises at least one deflection surface, said retaining rod curved upwardly away from the slope.

5. The device of claim 4, wherein said lifting elements comprise a slanted surface.

6. The device of claim 5, wherein said lifting elements are arranged for at least one of rotating, swivelling, and shifting with respect to said retaining rod.

7. The device of claim 6, wherein said lifting elements are mounted at a certain angle with respect to said retaining rod.

8. The device of claim 7, wherein said lifting elements are at least one of substantially designed flat, curved and volume-like.

9. The device of claim 8, wherein several of said retaining rods are combined.

10. The device of claim 9, wherein at least one of said lifting elements is mounted to several of said retaining rods.

11. The device of claim 10, wherein said retaining rod is of the shape of at least one of round, elliptical and angular.

12. The device of claim 11, wherein said retaining rod is elastic.

* * * * *